US009827653B2

(12) United States Patent
Cheng et al.

(10) Patent No.: US 9,827,653 B2
(45) Date of Patent: Nov. 28, 2017

(54) SCREWING ACCESSORY DEVICE

(71) Applicant: Wistron Corporation, New Taipei (TW)

(72) Inventors: Jui-Kai Cheng, New Taipei (TW); Chia-Lin Yu, New Taipei (TW)

(73) Assignee: WISTRON CORPORATION, New Taipei (TW)

( * ) Notice: Subject to any disclaimer, the term of this patent is extended or adjusted under 35 U.S.C. 154(b) by 636 days.

(21) Appl. No.: 14/197,274

(22) Filed: Mar. 5, 2014

(65) Prior Publication Data

US 2015/0158158 A1 Jun. 11, 2015

(30) Foreign Application Priority Data

Dec. 11, 2013 (TW) ..... 102223381 U

(51) Int. Cl.

| | |
|---|---|
| ***B25B 15/02*** | (2006.01) |
| ***B25B 23/06*** | (2006.01) |
| ***B25B 23/12*** | (2006.01) |
| ***B25C 1/00*** | (2006.01) |
| *B25C 5/16* | (2006.01) |

(52) U.S. Cl.

CPC ..... *B25B 15/02* (2013.01); *B25B 23/06* (2013.01); *B25B 23/12* (2013.01); *B25C 1/001* (2013.01); *B25C 5/1606* (2013.01); *B25C 5/1627* (2013.01); *Y10T 29/535* (2015.01)

(58) Field of Classification Search

CPC ..... B25B 15/02; B25B 23/12; B25B 23/06; B25C 5/1606; B25C 5/1627; B25C 1/001; Y10T 29/535; Y10T 29/49934; Y10T 29/49945; Y10T 29/49947; Y10T 29/49963

USPC ..... 29/813, 520, 525, 525.01, 525.11; 81/434

See application file for complete search history.

(56) References Cited

U.S. PATENT DOCUMENTS

| | | | | |
|---|---|---|---|---|
| 4,146,071 | A * | 3/1979 | Mueller | B25B 21/00 227/136 |
| 4,821,877 | A * | 4/1989 | Aab | B25B 21/007 206/338 |
| 4,998,452 | A * | 3/1991 | Blum | B25B 23/045 206/338 |
| 5,870,933 | A * | 2/1999 | Habermehl | B25B 23/045 227/136 |
| 6,647,836 | B1 * | 11/2003 | Habermehl | B25B 23/045 173/107 |
| 6,701,806 | B2 * | 3/2004 | Swanson | B25B 21/002 81/13 |
| 6,959,630 | B2 * | 11/2005 | Habermehl | B25B 23/045 227/136 |
| 2002/0035900 | A1 * | 3/2002 | Obermeier | B25B 23/045 81/434 |

(Continued)

FOREIGN PATENT DOCUMENTS

| | | | | |
|---|---|---|---|---|
| WO | WO 2013066255 | A1 * | 5/2013 | B25B 23/045 |

*Primary Examiner* — Christopher Besler
*Assistant Examiner* — Bayan Salone
(74) *Attorney, Agent, or Firm* — McClure, Qualey & Rodack, LLP

(57) ABSTRACT

The screwing accessory device comprises a receiving box, a rack and a pushing component. The receiving box is for receiving the screwed component. The rack is connected to the receiving box. The pushing component is disposed within the receiving box and is used for pushing the screwed component.

15 Claims, 9 Drawing Sheets

(56) References Cited

U.S. PATENT DOCUMENTS

| | | | | |
|---|---|---|---|---|
| 2003/0110908 | A1* | 6/2003 | Habermehl | B25B 23/045 81/434 |
| 2003/0178333 | A1* | 9/2003 | Pally | F16B 27/00 206/345 |
| 2004/0006860 | A1* | 1/2004 | Haytayan | B25B 21/002 29/525.01 |
| 2012/0017728 | A1* | 1/2012 | Schmidt | B25B 11/007 81/57.37 |
| 2012/0061443 | A1* | 3/2012 | Chen | B25C 5/1658 227/119 |
| 2014/0305068 | A1* | 10/2014 | Svanberg | B25B 23/045 52/711 |
| 2015/0048138 | A1* | 2/2015 | Chen | B25C 5/06 227/109 |

* cited by examiner

SCREWING ACCESSORY DEVICE

This application claims the benefit of Taiwan application Serial No. 102223381, filed Dec. 11, 2013, the subject matter of which is incorporated herein by reference.

BACKGROUND OF THE INVENTION

Field of the Invention

The invention relates in general to a screwing accessory device, and more particularly to a screwing accessory device having a receiving box for screwed components.

Description of the Related Art

It is usual to screw a screwed component to a workpiece. However, when a size of the screwed component is smaller than a finger, the screwed component is easy to drop, and thus a screwing efficiency is reduced. For this reason, how to make the screwing process more efficient is one goal for an industry in this technology field.

SUMMARY OF THE INVENTION

The invention is directed to a screwing accessory device capable of increasing screwing efficiency.

According to one embodiment of the present invention, a screwing accessory device is provided. The screwing accessory device comprises a receiving box, a rack and a pushing component. The receiving box is for receiving the screwed component. The rack is connected to the receiving box. The pushing component is disposed within the receiving box and is used for pushing the screwed component.

The above and other aspects of the invention will become better understood with regard to the following detailed description of the preferred but non-limiting embodiment(s). The following description is made with reference to the accompanying drawings.

DETAILED DESCRIPTION OF THE INVENTION

Referring to FIGS. 1A to 1E, an operation process of a screwing accessory device according to an embodiment of the invention is illustrated.

Figure 1A:
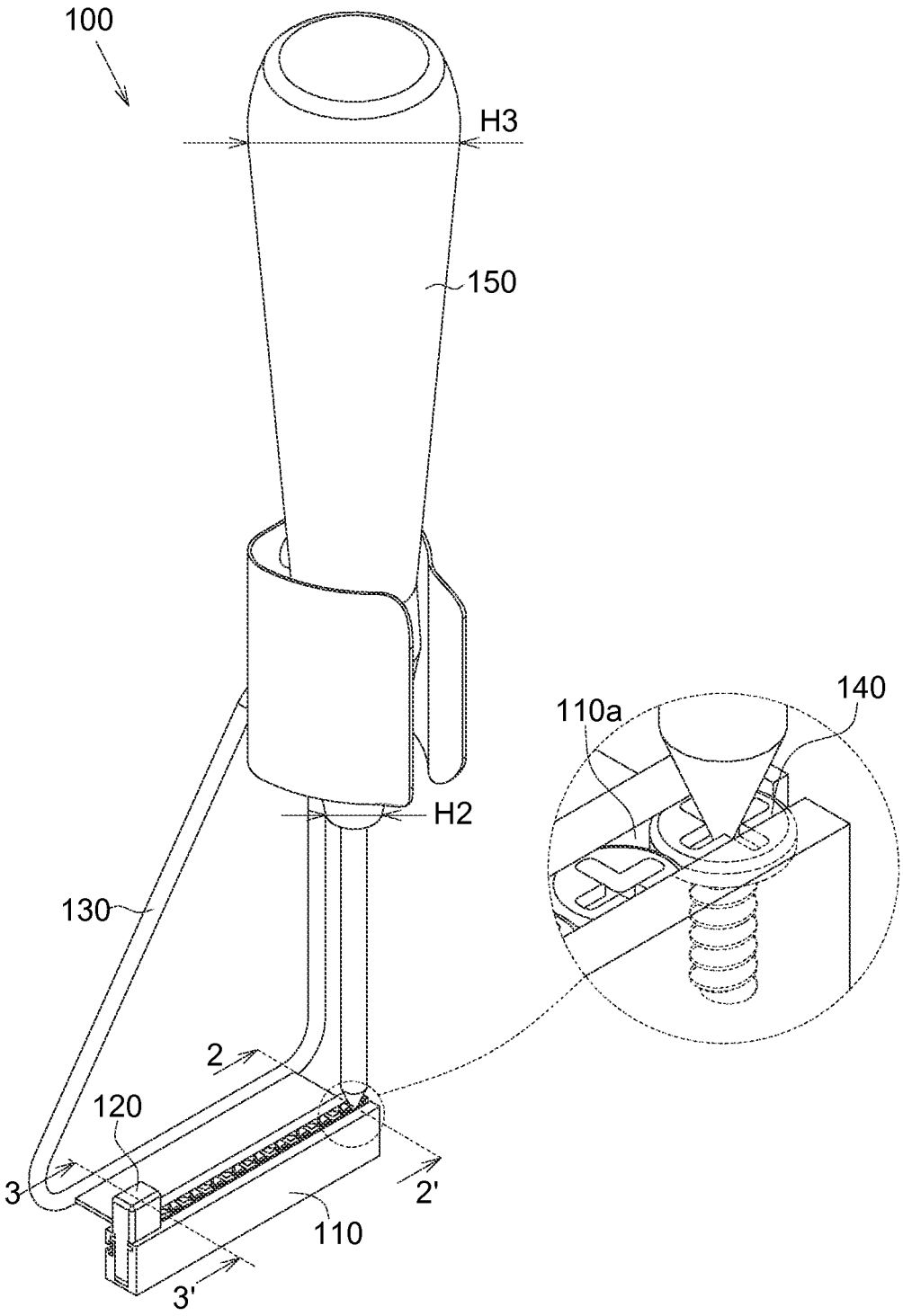
FIGS. 1A to 1E illustrate an operation process of a screwing accessory device according to an embodiment of the invention.

As illustrated in FIG. 1A, the screwing accessory device 100 comprises a receiving box 110, a pushing component 120 and the rack 130.

The receiving box 110 has a receiving space 110*a* to receive several screwed components 140. Accordingly, a problem of the screwed components 140 disorderly straggling down the ground or the top of the table and a problem of the screwed components 140 being easy to drop to the ground may be prevented. The screwing tool 150 is screwdriver, for example. The screwing tool 150 may be operated by hand to capture the screwed components 140. In detail, the rack 130 may be held by one hand, and the screwing tool 150 may be operated by another hand. In another embodiment, the screwing tool 150 may be operated by automatic equipment (such as robotic arm). In the present embodiment, an end 151 of the screwing tool 150 may be magnetized and the screwed component 140 may be formed by a material including a magnetic material, such as metal; accordingly, the screwed components 140 can be absorbed by the end 151 of the screwing tool 150 through a magnetic force.

Figure 1B:
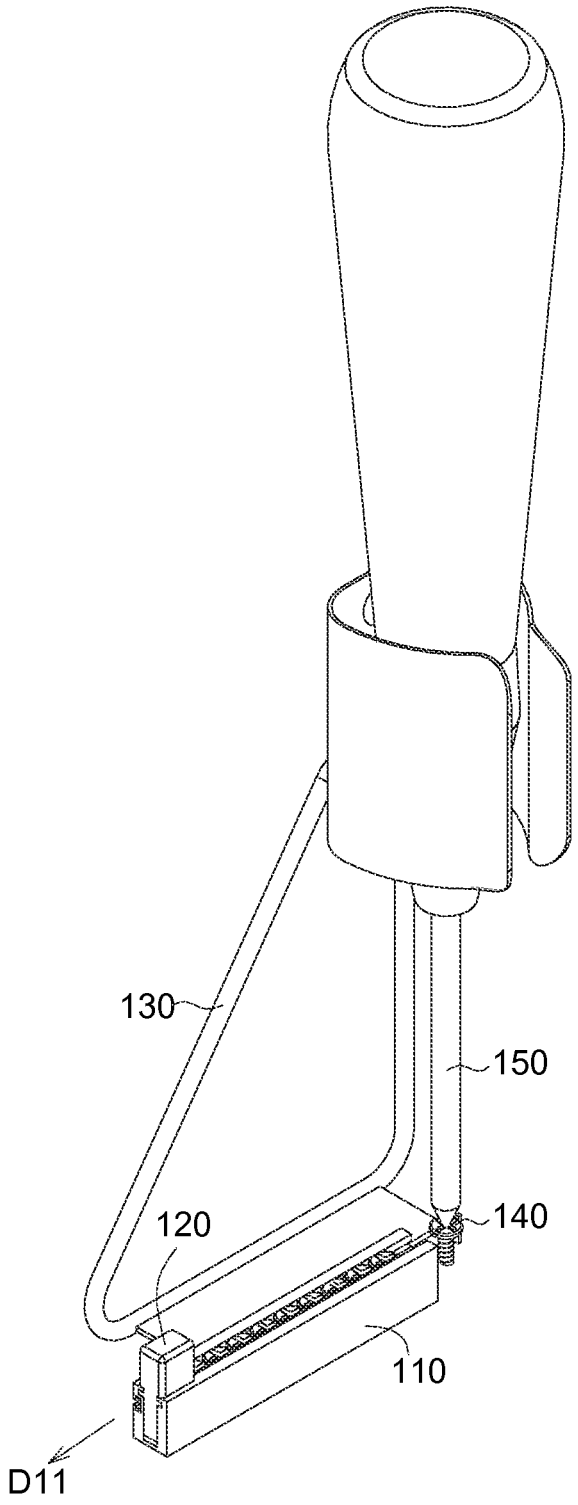
Figure 1C:
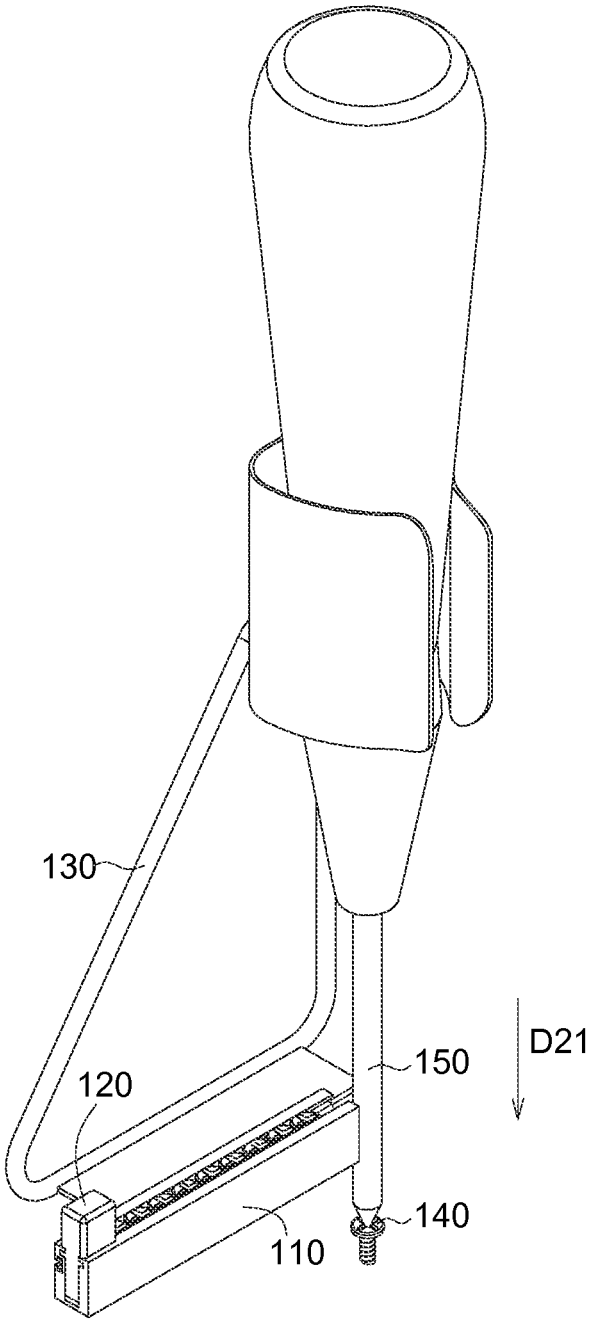

As illustrated in FIG. 1B, since the receiving box 110 is slidably connected to the rack 130, the receiving box 110 may move toward a direction D11 away from the screwing tool 150 to vacate a feeding space after the screwing tool 150 captures the screwed component 140; accordingly, the receiving box 110 may be prevented from blocking the screwing tool 150 moving along a screwing direction D21 (illustrated in FIG. 1C)

As illustrated in FIG. 1C, since the receiving box 110 vacates the feeding space for the screwing tool 150, the screwing tool 150 may move along the feeding direction D21 form screwing the captured screwed component 140 to a workpiece (not illustrated).

Figure 1D:
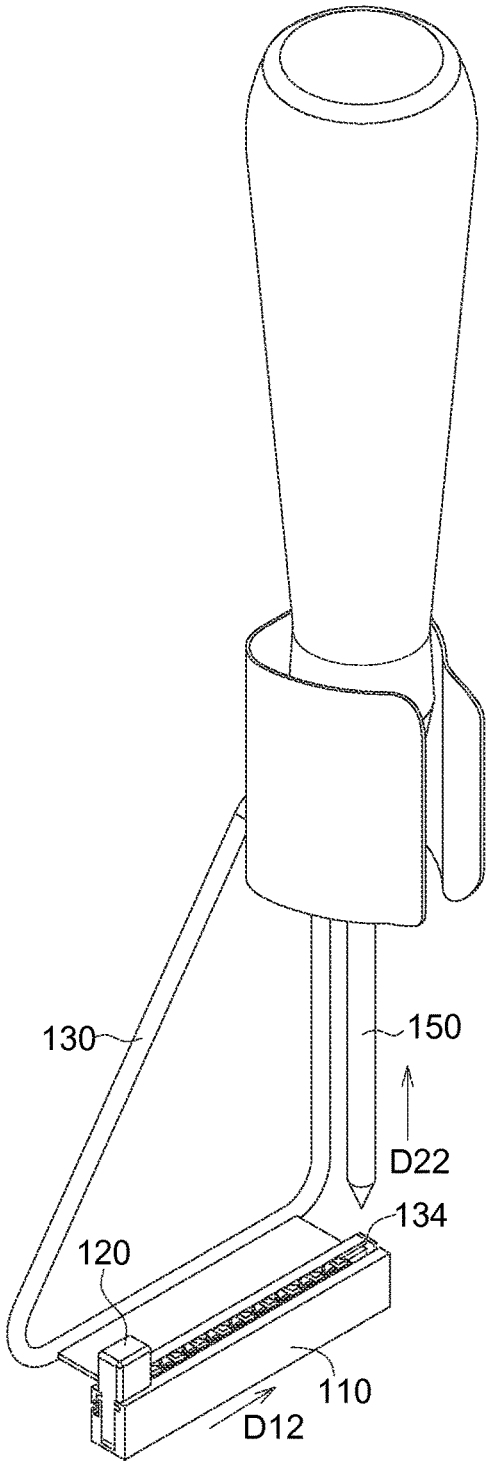

As illustrated in FIG. 1D, after the screwing tool 150 screws the screwed component 140 to the workpiece (not illustrated), the screwing tool 150 moves to above the receiving box 110 toward a reverse direction D22 of the screwing direction D21. After the screwing tool 150 moves to above the receiving box 110, the receiving box 110 moves toward a direction D12 approaching the screwing tool 150 to drive the screwed components 140 within the receiving box 110 to approach the screwing tool 150. Since the screwed component 140 under the screwing tool 150 is captured during preceding step (illustrated in FIG. 1A), a region under the screwing tool 150 is blank state, that is, there is no screwed component 140 in the region.

Figure 1E:
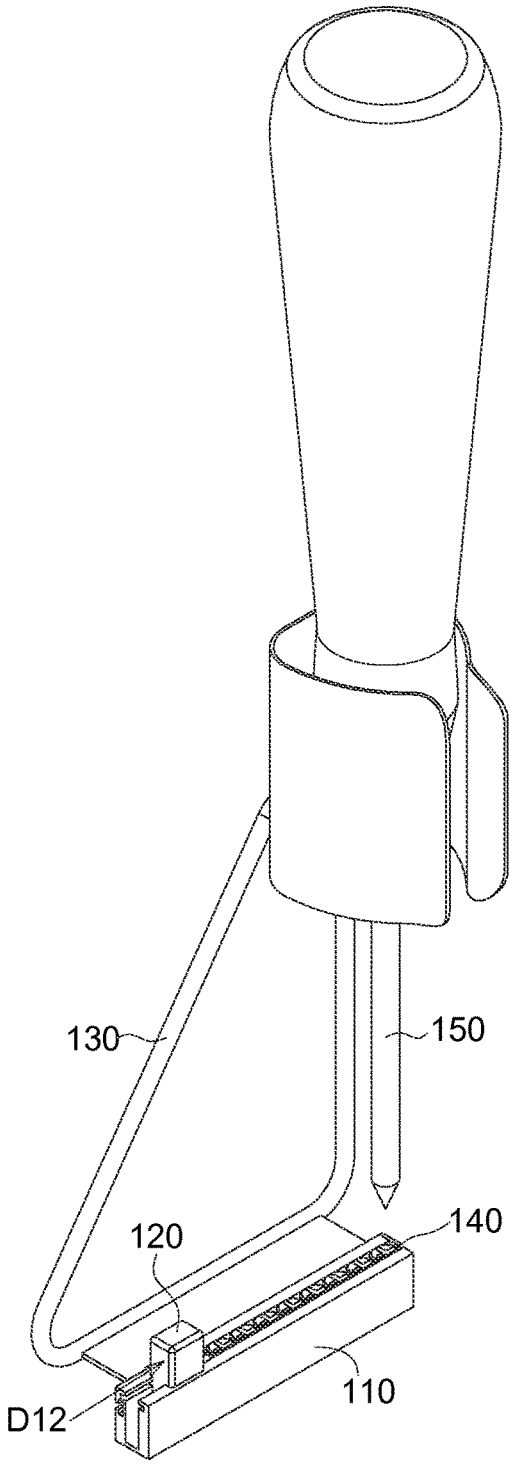

As illustrated in FIG. 1E, the pushing component 120 pushes the screwed components 140 within the receiving box 110 toward the direction D12 approaching the receiving box 110, such that the screwed component 140 most close to the screwing tool 150 may move to under the screwing tool 150 for being captured by the screwing tool 150. The following operations may repeat the steps illustrated in FIGS. 1A to 1E, and the similarity is not repeated. When the screwed components 140 within the receiving box 110 run out, the receiving box 110 without the screwed components 140 may be detached from the rack 130, and then another receiving box 110 filled up with screwed components 140 may be installed in the rack 130 for continuing screwing.

As described above, since the design of the screwing accessory device 100, the screwed components 140 may be efficiently managed, and the problem of the screwed components 140 disorderly straggling down the ground or the top of the table and the problem of the screwed components 140 being easy to drop to the ground can be resolved or be improved. In addition, the screwing efficiency may be increased due to the relative motions of the receiving box 110, the pushing component 120 and the rack 130. The structure of the screwing accessory device 100 is described below.

Figure 2:
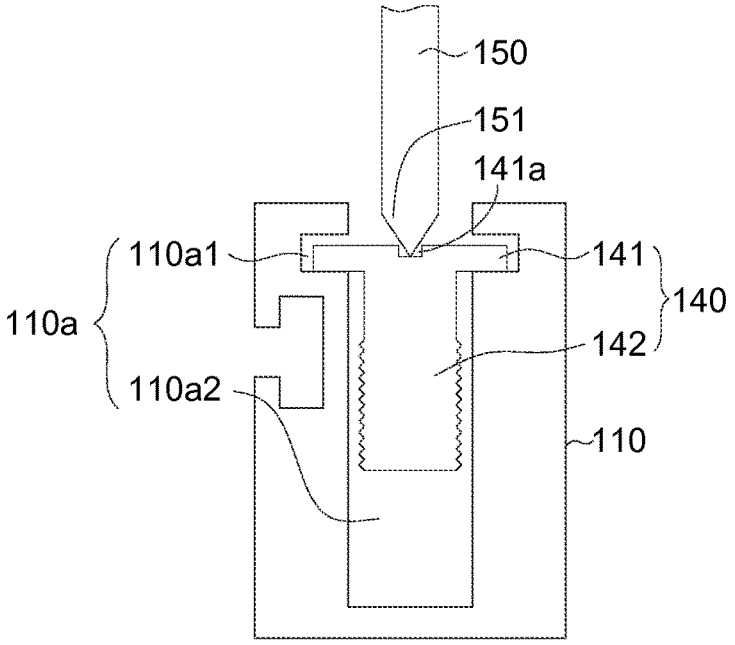
FIG. 2 illustrates a cross-sectional view of the receiving box of FIG. 1A along a direction 2-2'.

Referring to FIG. 2, a cross-sectional view of the receiving box of FIG. 1A along a direction 2-2' is illustrated. The screwed component 140 comprises a capturing portion 141 and a screwed portion 142. The capturing portion 141 has a recess 141*a*, such as a flat-headed recess, a cross-shaped recess, a tetragonal recess, a hexagonal recess or other structure conducive to the screwed components 140 being captured. The end of the screwing tool 150 has a structure corresponding to the recess 141*a* for entering the recess 141*a* to capture and rotate the screwed component 140. The screwed portion 142 has a male thread for being screwed to the workpiece (not illustrated). In detail, the screwed component 140 may be various screws or bolts.

The receiving space 110*a* of the receiving box 110 comprises a first position limiting groove 110*a*1 and a second position limiting groove 110*a*2. The capturing portion 141 and the screwed portion 142 of the screwed component 140 are located within the first position limiting groove 110*a*1 and the second position limiting groove 110*a*2 respectively. The first position limiting groove 110*a*1 is closer to the screwing tool 150 than the second position limiting groove 110*a*2 is; accordingly, the capturing portion 141 of the screwed component 140 within the receiving box 110 may face the screwing tool 150 for being captured by the screwing tool 150.

Figure 3:
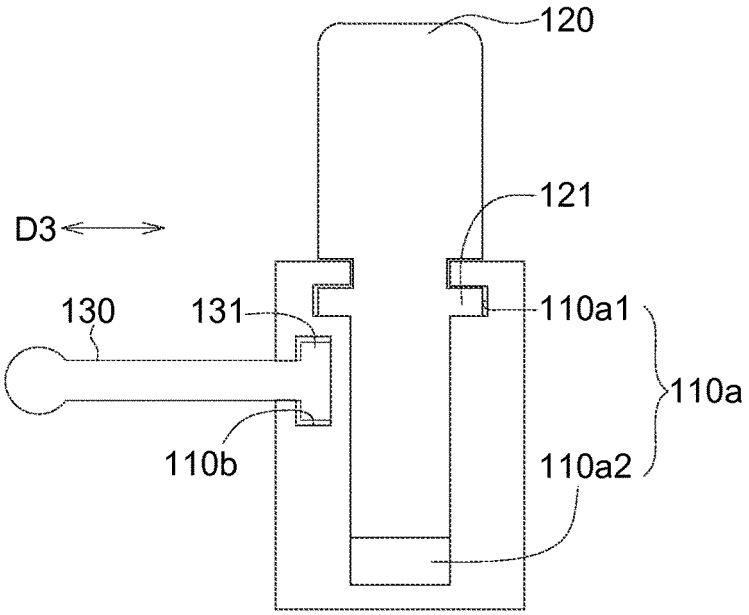
FIG. 3 illustrates a cross-sectional view of the receiving box of FIG. 1A along a direction 3-3'.

Referring to FIG. 3, a cross-sectional view of the receiving box of FIG. 1A along a direction 3-3' is illustrated. The pushing component 120 comprises a pushing portion 121. The pushing portion 121 is slidably disposed within the first position limiting groove 110*a*1 for pushing the capturing portion 141 (illustrated in FIG. 2) of the screwed component 140 to move. The receiving box 110 further has a sliding groove 110*b*, and the rack 130 has a sliding rail 131. The sliding rail 131 of the rack 130 is slidably disposed within the sliding groove 110*b* of the receiving box 110 for sliding with respective to the sliding groove 110*b*. In the present embodiment, the sliding groove 110*b* is a T-shaped groove, and the sliding rail 131 is a T-shaped rail. Through the design of T-shape, the sliding rail 131 not only may slide with respect to the sliding groove 110*b*, but also may be prevented from being detached from the sliding groove 110*b* along a direction D3 substantially perpendicular to the direction D11 (illustrated in FIG. 1B) and the screwing direction D21 (illustrated in FIG. 1C).

Figure 4:
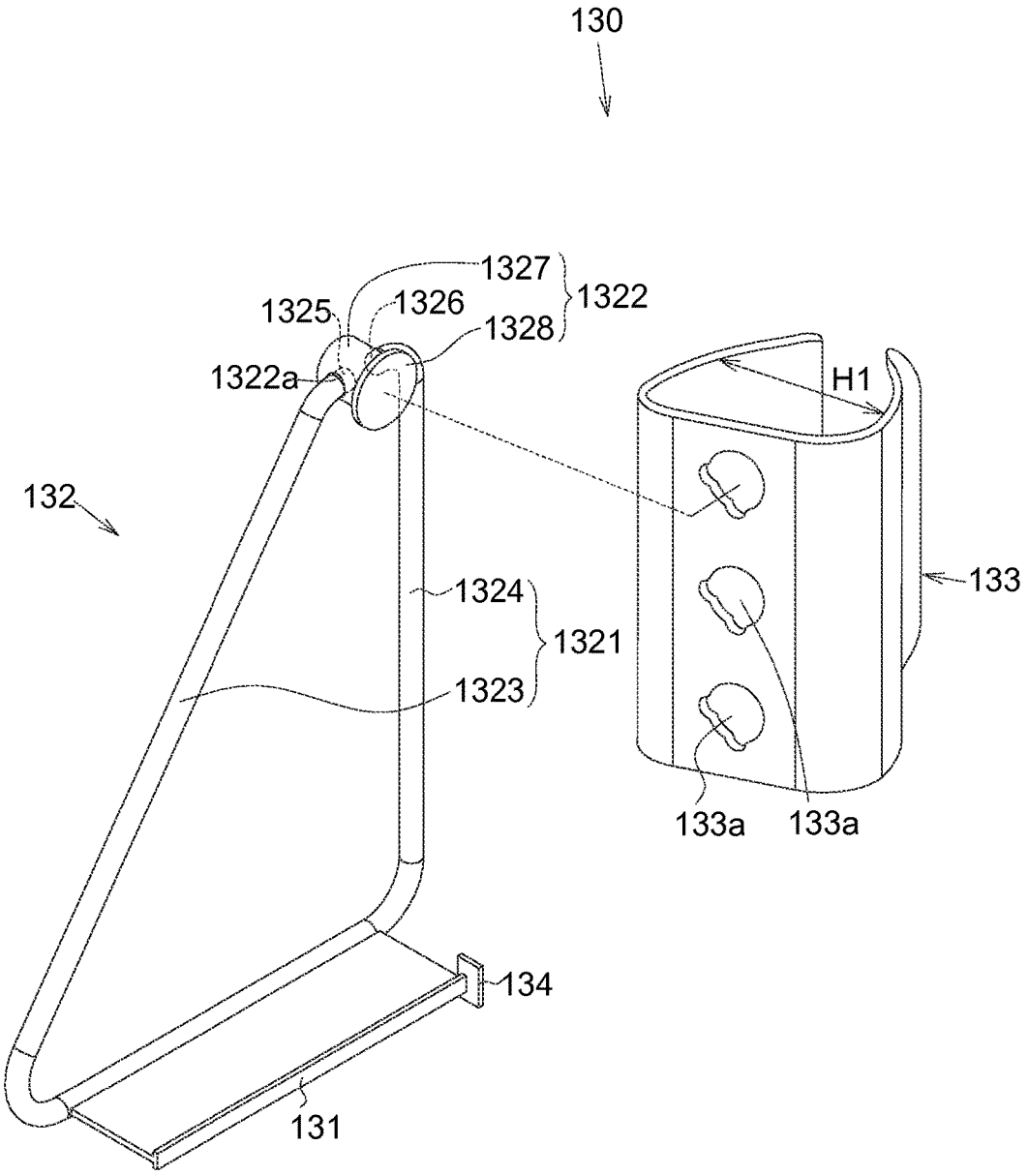
FIG. 4 illustrates a decomposed view of the rack of FIG. 1A.

Referring to FIG. 4, a decomposed view of the rack of FIG. 1A is illustrated. The rack 130 comprises a connecting frame 132 and a ring 133. The connecting frame 132 comprises the sliding rail 131, an elastic clamp pair 1321 and an engaging component 1322, wherein the sliding rail 131 is fixedly disposed the elastic clamp pair 1321. The elastic clamp pair 1321 comprises a first elastic clamp 1323 and a second elastic clamp 1324 connecting to the first elastic clamp 1323. An end 1325 of the first elastic clamp 1323 and an end 1326 of the second elastic clamp 1324 are engaged with two ends of a piercing hole 1322*a* of the engaging component 1322; accordingly, the elastic clamp pair 1321 may be prevented from being easily detached from the engaging component 1322. Since the first elastic clamp 1323 and the second elastic clamp 1324 both have flexibility, the elastic clamp pair 1321 may be detached from the piercing hole 1322*a* of the engaging component 1322 by an applying force. The engaging component 1322 comprises an engaging portion 1327 and a stopper 1328 connecting to the engaging portion 1327. The above piercing hole 1322*a* pierces the engaging portion 1327.

The ring 133 has a plurality of engaging through holes 133*a*. After the engaging component 1322 is engaged with one of the engaging through holes 133*a*, the stopper 1328 of the engaging component 1322 and the elastic clamp pair 1321 are located in an inner side of the ring 133 and an outer side of the ring 133 respectively. Since an outer diameter of the stopper 1328 is larger than an inner diameter of the engaging through hole 133*a*, the connecting frame 132 may be prevented from being easily detached from the ring 133. In addition, several engaging through holes 133*a* are located at different heights, and the engaging component 1322 of the connecting frame 132 may be engaged with anyone of the engaging through holes 133*a* for adjusting a relative position of the connecting frame 132 and the ring 133. Further, since the engaging through holes 133*a* are located at different heights, a relative height of the connecting frame 132 and the ring 133 may be adjusted with accordance to a feeding stroke of the screwing tool 150 or a length of the screwing tool 150. In another embodiment, several engaging components 1322 may be fixedly disposed on the engaging through holes 133*a* to become a portion of the ring 133; under such design, the relative height of the connecting frame 132 and the ring 133 may be adjusted through the elastic clamp pair 1321 being detached from or assembling in the engaging component 1322 fixedly disposed on the ring 133.

The ring 133 may hitch the screwing tool 150 for preventing from the screwing tool 150 easily dropping. In detail, as illustrated in FIG. 4, the ring 133 has an inner diameter H1, and the screwing tool 150 (illustrated in FIG. 1A) has a smaller outer diameter H2 and a larger outer diameter H3. The inner diameter H1 of the ring 133 ranges between the smaller outer diameter H2 and the larger outer diameter H3 of the screwing tool 150. Accordingly, even if the screwing tool 150 is released, the screwing tool 150 is prevented from dropping to the ground or being detached from the ring 133 due to the larger outer diameter H3 of the screwing tool 150 being larger than the diameter H1 of the ring 133. In addition, the screwing tool 150 may move up and down with respect to the ring 133 due to the smaller outer diameter H2 of the screwing tool 150 being smaller than the diameter H1 of the ring 133.

Figure 5:
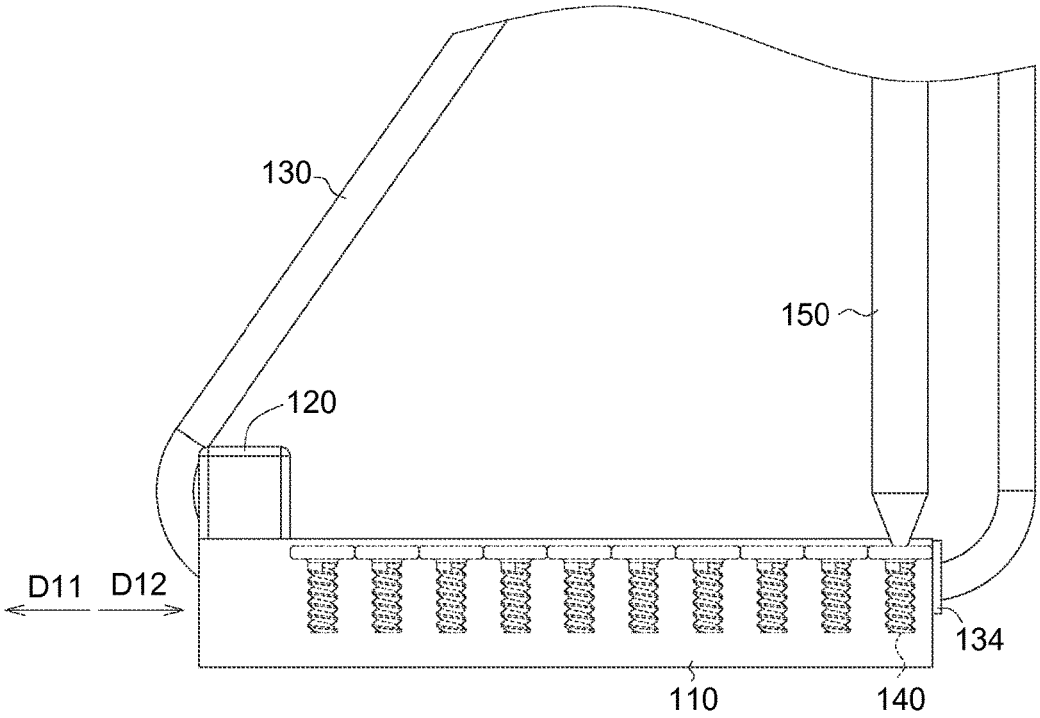
FIG. 5 illustrates a local front view of the screwing accessory device of FIG. 1A.

Referring to FIG. 5, a local front view of the screwing accessory device of FIG. 1A is illustrated. The rack 130 further comprises a stopper 134. The stopper 134 is protrudently disposed on the sliding rail 131 (as illustrated in FIG. 4) for restricting the motion range of the receiving box 110. In detail, when the receiving box 110 moves toward the direction D12, the receiving box 110 may be prevented from being easily pushed out of the sliding rail 131 (as illustrated in FIG. 4) due to the blocking by the stopper 134. In addition, through the design of the stopper 134, during the receiving box 110 being pushed toward the direction D12 (as illustrated in FIG. 1D), the receiving box 110 may be pushed to be blocked by the stopper 134 regardless of consideration for the moving distance of the receiving box 110; accordingly, a required operating time may be reduced and a screwing efficiency may be increased. In addition, during the pushing component 120 pushing the screwed components 140 toward the direction D12, the screwed components 140 may be prevented from being pushed out of the receiving box 110 toward the direction D12 due to the screwed components 140 being blocked by stopper 134.

In addition, since the screwed components 140 within the receiving box 110 are located between the pushing component 120 and the stopper 134, the screwed component 140 may be prevented from being detached from the receiving box 110. In detail, the screwed component 140 may be prevented from being detached from the receiving box 110 toward the direction D11 due to the blocking by the pushing component 120, and the screwed component 140 may be prevented from being detached from the receiving box 110 toward the direction D12 due to the blocking by the pushing component 120.

Figure 6:
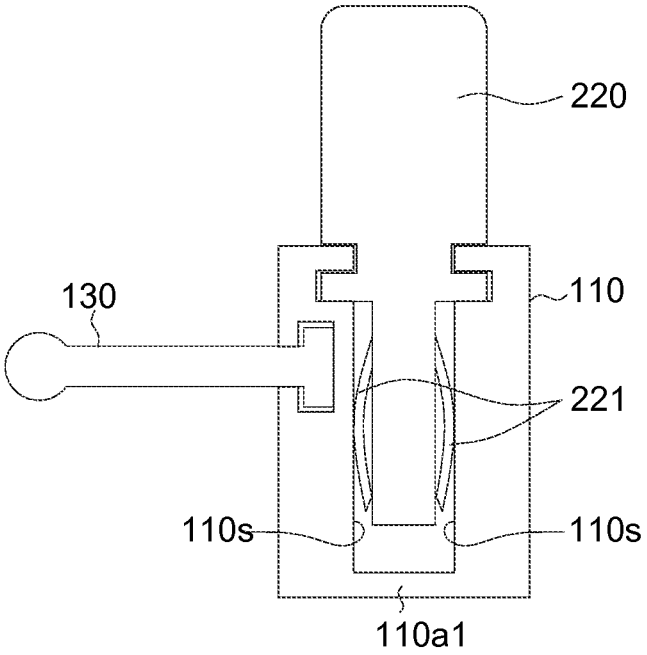
FIG. 6 illustrates a cross-sectional view of a pushing component and a receiving box according to another embodiment of the invention.

Referring to FIG. 6, a cross-sectional view of a pushing component and a receiving box according to another embodiment of the invention is illustrated. The screwing accessory device of the present embodiment comprises the receiving box 110, a pushing component 220 and the rack 130. The pushing component 220 is different from the pushing component 120 described above in that the pushing component 220 further comprise an elastic clamp pair 221. The elastic clamp pair 221 press on two opposite sidewalls 110*s* of the receiving space 110*a*, such that the pushing component 220 is not easy to be detached from the receiving box 110; accordingly, the screwed components 140 (not illustrated) within the receiving space 110*a* is not easy to be detached from the receiving box 110 due to blocking by the pushing component 220.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A screwing accessory device, capable of assisting a screwing tool to capture a screwed component, comprising:

a receiving box having receiving space for receiving the screwed component;

a rack connecting to the receiving box;

a pushing component disposed within the receiving space of the receiving box and is used for pushing the screwed component;

wherein the receiving box is slidably connected to the rack for sliding with respect to the rack; and wherein the receiving box has a sliding groove, the rack has a sliding rail, and the sliding rail of the rack is slidably disposed on the sliding groove of the receiving box for sliding with respect to the sliding groove.

2. The screwing accessory device according to claim 1, wherein the sliding groove is T-shape groove, and the sliding rail is a corresponding T-shape rail.

3. The screwing accessory device according to claim 1, wherein the rack comprises:

a stopper protrudently disposed on the sliding rail for blocking the receiving box.

4. The screwing accessory device according to claim 1, wherein the rack comprises:

a ring for hitching the screwing tool; and a connecting frame connecting the ring and the receiving box.

5. The screwing accessory device according to claim 4, wherein the ring comprises a plurality of engaging portions locating at different heights, and the connecting frame is engaged with one of the engaging portions.

6. The screwing accessory device according to claim 4, wherein the screwing tool has a smaller outer diameter and a larger outer diameter, the ring has an inner diameter, and the inner diameter ranges between the smaller outer diameter and the larger outer diameter.

7. The screwing accessory device according to claim 4, wherein the connecting frame comprises a sliding rail, an elastic clamp pair and an engaging component, the elastic clamp pair connects the sliding rail and the engaging component, and the connecting frame is engaged with the ring by the engaging component.

8. The screwing accessory device according to claim 4, wherein the connecting frame comprises a sliding rail, an elastic clamp pair and an engaging component, the elastic clamp pair is fixedly connected to the sliding rail, and the elastic clamp pair is detachably connected to the engaging component.

9. The screwing accessory device according to claim 7, wherein the engaging component comprises a stopper, and the stopper and the elastic clamp pair are located in an inner side of the ring and an outer side of the ring respectively.

10. The screwing accessory device according to claim 9, wherein the ring has an engaging through hole, and an outer diameter of the stopper is larger than an inner diameter of the engaging through hole.

11. The screwing accessory device according to claim 7, wherein the engaging component has a piercing hole, the elastic clamp pair comprises a first elastic clamp and a second elastic clamp, and an end of the first elastic clamp and an end of the elastic clamp are engaged with two end of the piercing hole.

12. The screwing accessory device according to claim 1, wherein the pushing component comprises an elastic clamp pair, and the elastic clamp pair presses on a sidewall of the receiving space.

13. The screwing accessory device according to claim 1, wherein the screwed component comprises a capturing portion and a screwed portion, the receiving box comprises a first position limiting groove and a second position limiting groove, the first position limiting groove is used for receiving the capturing portion, and the second position limiting groove is used for receiving the screwed portion.

14. The screwing accessory device according to claim 13, wherein the first position limiting groove is closer to the screwing tool than the second position limiting groove is.

15. The screwing accessory device according to claim 1, wherein the screwing tool is screwdriver.

* * * * *